US006419590B1

(12) United States Patent
Criger

(10) Patent No.: US 6,419,590 B1
(45) Date of Patent: Jul. 16, 2002

(54) PORTABLE GOLF PUTTING TARGET AND GAME IMPROVEMENT SYSTEM

(76) Inventor: Robert O. Criger, P.O. Box 3222, Visalia, CA (US) 93278

( * ) Notice: Subject to any disclaimer, the term of this patent is extended or adjusted under 35 U.S.C. 154(b) by 0 days.

(21) Appl. No.: 09/565,255

(22) Filed: May 5, 2000

(51) Int. Cl.[7] ..... A63B 57/00
(52) U.S. Cl. ..... 473/174
(58) Field of Search ..... 473/173, 174, 473/180, 195, 196, 162; 273/123 R, 127 R

(56) References Cited

U.S. PATENT DOCUMENTS

| | | | | |
|---|---|---|---|---|
| 1,738,265 A | * | 12/1929 | Scanlan | 473/180 X |
| 3,490,769 A | * | 1/1970 | Torbett | 473/196 |
| 3,584,877 A | | 6/1971 | Florian | |
| 4,171,134 A | | 10/1979 | Reck | |
| 4,846,478 A | | 7/1989 | Saint-Criq | |
| 4,877,250 A | | 10/1989 | Centafanti | |
| 5,401,027 A | | 3/1995 | Surbeck | |
| 5,435,560 A | | 7/1995 | Kehoe | |
| 5,607,360 A | * | 3/1997 | Shiffman | 473/180 |
| 5,779,567 A | * | 7/1998 | Durso | 473/180 X |
| 5,830,076 A | | 11/1998 | Borys | |
| 6,241,621 B1 | * | 6/2001 | Maher | 473/180 X |

FOREIGN PATENT DOCUMENTS

| | | | | |
|---|---|---|---|---|
| CA | 490717 | * | 2/1953 | 273/181 R |

* cited by examiner

*Primary Examiner*—Raleigh W. Chiu
(74) *Attorney, Agent, or Firm*—Mark D. Miller

(57) ABSTRACT

The present invention provides a scoring overlay in the form of a target and a system for improving golf putting. The overlay is designed for use after a golf putt to provide a score based on the position of the ball relative to the hole. The center of the overlay is placed over the hole on the golf green, and the overlay is oriented based on the direction from which the putt was made. A score is awarded based on the position of the ball on the overlay. Scores are based on how close the ball is to the hole; however, a higher score is awarded for a ball a given distance from the hole that was hit hard enough to reach or pass the hole than for a ball equally distant from the hole that was not hit hard enough to reach the hole. Similarly, lower scores are provided for golf balls hit off line from center, either far to the right or far to the left. The invention also includes a method for improving putting through a game using the overlay.

10 Claims, 2 Drawing Sheets

PORTABLE GOLF PUTTING TARGET AND GAME IMPROVEMENT SYSTEM

1. Background of the Invention

The present invention relates to golf putting, and more particularly to a new portable golf putting target and system for use in improving a golfer's putting game.

2. Field of the Invention

Putting is an important part of the game of golf. On an ordinary golf course, of the normal 72 strokes designated for par, half of them (36) are usually for putting on the green. Accordingly, if a golf player can reduce the number of putting strokes, his or her game can be improved dramatically.

There are two essential aspects to good putting in golf: proper line and distance. If the ball is stroked hard enough on the correct line, it will drop in the hole. Unfortunately, it is all too common for golf players to miss the correct line for the hole, or to leave the ball short of the hole. Most experienced golfers follow two basic rules in putting. First, if there is any break in the green, they definitively plan for their ball to wind up on the high side of the hole. Second, they concentrate on getting the ball up to the hole, or even a little past it. Each of these rules improves the chances of making the putt.

The closer the player gets to the proper line, the better the chances that the ball will drop. However, even if the player's line is perfect, if the stroke leaves the ball short of the hole, it has no opportunity to drop and will result in adding a stroke to the player's score. Accordingly, it is desirable to provide a method and apparatus to assist the golfer in improving these two aspects of his or her game.

SUMMARY OF THE INVENTION

The present invention provides an overlay in the form of a target and a system for improving golf putting. The overlay is designed for use after a putt to provide a score based on the position of the ball relative to the hole. The center of the overlay is placed over the hole on the golf green, and the overlay is oriented based on the direction from which the putt was made. A score is awarded based on the position of the ball. Scores are based on how close the ball is to the hole; however, a higher score is awarded for a ball a given distance from the hole that was hit hard enough to reach or pass the hole than for a ball equally distant from the hole that was not hit hard enough to reach the hole.

The invention also includes a method for improving putting through a game using the overlay.

The scoring overlay is made of a flat transparent material that is portable and collapsible. A series of lines forming concentric circles are provided on the overlay surrounding a central point. The central circular area is made the same size as the golf hole. The remaining concentric circular lines are spaced evenly apart defining annular areas between them. These remaining circular lines are bisected into two sections by a single straight line which crosses the overlay tangential to the center circle, resulting in arcuate areas on either side of the straight line. The straight line is designed to have a horizontal orientation that is perpendicular to the path of the golf ball putted towards the hole. In this orientation, the horizontal line is below the central circular area thereby defining larger arcuate areas above the line (i.e., farther from where the putt was initiated) and smaller arcuate areas below the line (i.e., closer to where the putt was initiated).

Scoring values or numerals are placed in the central circular area and in the arcuate areas surrounding it. The highest score (e.g. 10) is provided in the central circular area. This would be the score for a golf ball hit into the hole. Gradually decreasing score values are provided in the annular areas surrounding the center, the more distant areas having lower values. However, the scores on each annular area below the horizontal line are deliberately made lower than the scores for the same annular area above the line. Thus, for illustrative purposes and by way of example only, the first circle away from the center might have a score value of 9 in the arcuate area above the line, but a value of only 8 in the corresponding arcuate area below the line. The purpose for establishing the scoring values in this way is to provide higher scores for golf balls that are hit hard enough to reach or pass the hole than those which do not reach the hole.

In addition to the concentric circles, two pairs of nearly vertical parallel lines are also provided. While the lines within each pair are parallel to each other, the pairs of lines are not parallel to each other. These pairs of lines are provided on either side of the overlay such that they intersect the horizontal line at nearly perpendicular angles. However, the parallel lines on the right side of center slope slightly to the right from bottom to top (i.e., from closer to farther away from where the putt was initiated), and the parallel lines on the left side of center slope slightly to the left from bottom to top. Thus, the ends of each of the pairs of lines are closer together on the section below the horizontal line (closer to the initiation of the putt), and farther apart on the section above the line (farther from the initiation of the putt). The parallel lines of each pair are spaced apart the same distance as between the lines of each of the concentric circles. The parallel lines are tangential to and intersect two of the outer circular lines. The arcuate areas between the parallel lines and the arcuate areas on the perimeter outside of the parallel lines (on the right and left edges of the target pattern) have decreased scoring values. This decrease provides lower scores for golf balls hit off line from center, either too far to the right or too far to the left.

The pattern on the overlay and the values of the scoring numerals in the spaces of the pattern are designed to provide more favorable scoring for positions that are closer to the hole, favoring positions on the upper section above the horizontal line, and favoring positions along the vertical center of the target.

In use, a series of putts with different distances are established on a putting green. All players putt a given hole from the same starting location. After each player putts, his or her ball is marked. When all the players of the group (e.g. a foursome) have putted a given hole and the positions of the balls have been noted, the overlay is placed such that the center circle of the overlay is directly over the hole. The overlay is oriented such that the horizontal line on the overlay is both (a) perpendicular to the imaginary line between the hole and the starting location (from which all players putted), and (b) on the side of the hole closest to the starting location. In this way, the higher scores on the overlay are even with or beyond the hole relative to the starting location. This scoring system rewards a player more for a ball that was hit hard enough to get to or past the hole, as compared to a ball that was not hit hard enough to even reach the hole. Similarly, higher scores are provided for golf balls hit closer to the vertical center of the target, as compared to balls hit either too far to the right or to the left. Scores are recorded for each hole. After all holes are completed, the player with the highest score is putting the best and wins the game. The game is a method of improving golf putting.

In an example of the game (called Putt Plot by the applicant), ten different putts are established on the putting green having varying distances of between about 6 and about 40 feet. It is preferred, but not necessary, that the first putt be from about 20 feet. No distance is repeated, but the exact sequence of each distance must be followed. The sequence should closely approach what an average golfer would face from green to green through a round, and should be purposefully sequenced in such a manner that the golfer does not learn too much from one putt to the next. This forces the golfer to concentrate on putting from widely varying distances in order to develop a mind-arm-hand relationship that results in a smooth, repeating stroke. The overlay is used to score each of the ten holes. At the conclusion of the game, the scores are totaled and tabulated, with 100 being a perfect score. Using a standardized Putt Plot sequence of holes, a Putter Rating (P.R.) may be established for each golfer, just as each golfer establishes a handicap.

It is therefore a primary object of the present invention to provide an overlay in the form of a target for use in golf putting that provides a scoring pattern that favors golf balls otherwise equidistant from the hole that are hit hard enough to reach or pass the hole over those which are not hit hard enough to even reach the hole.

It is also a primary object of the present invention to provide an overlay in the form of a target for use in golf putting that provides a scoring pattern that favors golf balls otherwise equidistant from the hole that are hit closer to the vertical center of the target than those which are hit farther to the right or to the left.

It also an important object of the present invention to provide a method and apparatus for improving a golfer's putting game which uses a scoring overlay in the form of a target that includes a scoring pattern that favors golf balls otherwise equidistant from the hole that are hit to or beyond the hole over those which do not reach the hole.

It also an important object of the present invention to provide a method and apparatus for improving a golfer's putting game which uses a scoring overlay in the form of a target that includes a scoring pattern that favors golf balls otherwise equidistant from the hole that are hit closer to the vertical center of the target than those which are hit farther to the right or to the left.

Other objects of the invention will be apparent from the detailed descriptions and the claims herein.

DETAILED DESCRIPTION OF THE PREFERRED EMBODIMENTS

Figure 1:
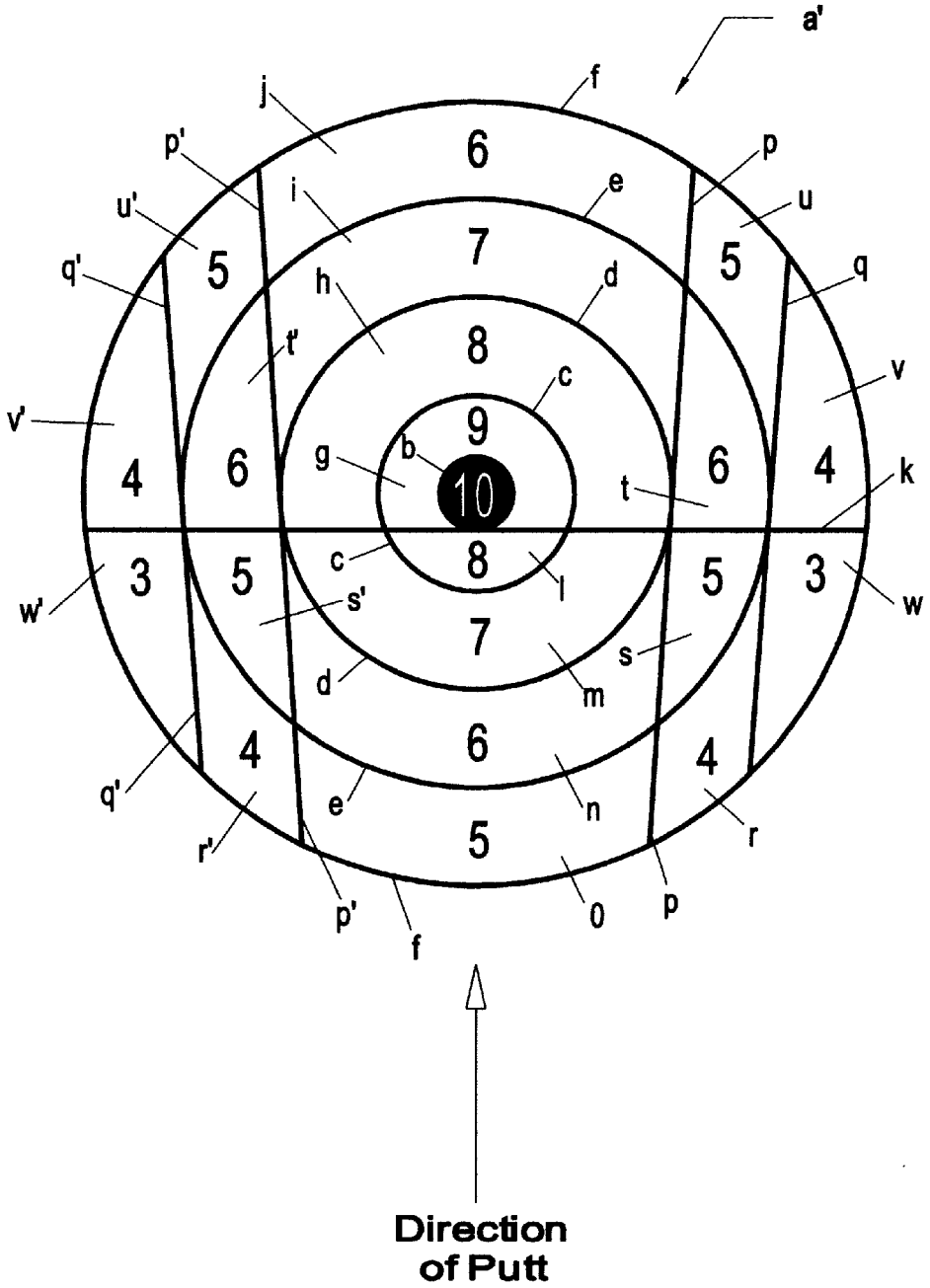
FIG. 1 is a top plan view of the target pattern of the present invention.

Referring to the drawings wherein like reference characters designate like or corresponding parts throughout the several views, and referring particularly to FIG. 1, it is seen that the invention includes a target-shaped pattern a having a center circle b surrounded by a series of concentric circular lines c, d, e, and f. Circle b represents the golf hole. The radius of the circle defined by line c is the same as the distance between each of lines c, d, e, and f. This results in a series of annular areas surrounding the center of the target pattern a.

A straight line k is provided on pattern a. Line k is tangential to circle b and intersects with each of lines c, d, e, and f. Line k is designed to have a horizontal orientation that is perpendicular to the path of the ball putted toward the hole as shown in FIG. 1. Line k is shorter than the diameter of circular line f, and does not evenly bisect the target pattern a. Instead, line k cuts across pattern a below circle b. This results in a group of arcuate areas above line k (g, h, i, and j) that are larger than the corresponding arcuate areas below line k (L, m, n and o). Scoring values are provided in circle b and in each of the arcuate areas. However, the values in the arcuate areas above line k (g, h, i, and j) are slightly higher than the values provided in the arcuate areas below the line (l, m, n and o). The scoring values may be any appropriate numbers, so long as the values above line k are higher than those below line k.

Two pairs of nearly vertical parallel lines p & q (and p' & q') are also provided on pattern a. Lines p and q are parallel to each other; similarly, lines p' and q' are also parallel to each other. However, the pairs of lines (pq) and (p',q') are not parallel to each other. These pairs of lines are provided on either side of the pattern a such that they intersect horizontal line k at nearly perpendicular angles. The parallel lines on the right side of center (p,q) slope slightly to the right from bottom to top, and the parallel lines on the left side of center (p',q') slope slightly to the left from bottom to top as shown in FIG. 1. Thus, the ends of each of the pairs of lines are closer together on the section below horizontal line k, and farther apart on the section above line k. The parallel lines of each pair (pq) and (p',q') are spaced apart the same distance as between the lines of each of the concentric circles c, d, e, and f. The parallel lines are also tangential to two of the circular lines: d and e. In particular, lines p and p' are tangential to circular line d; and lines q and q' are tangential to circular line e. The areas of intersection between the parallel lines and the concentric circles (r, s, t, u, v and w on the right edge of the target pattern a; and r', s', t', u', v' and w' on the left edge of the target pattern a) have decreased scoring values.

Figure 2:
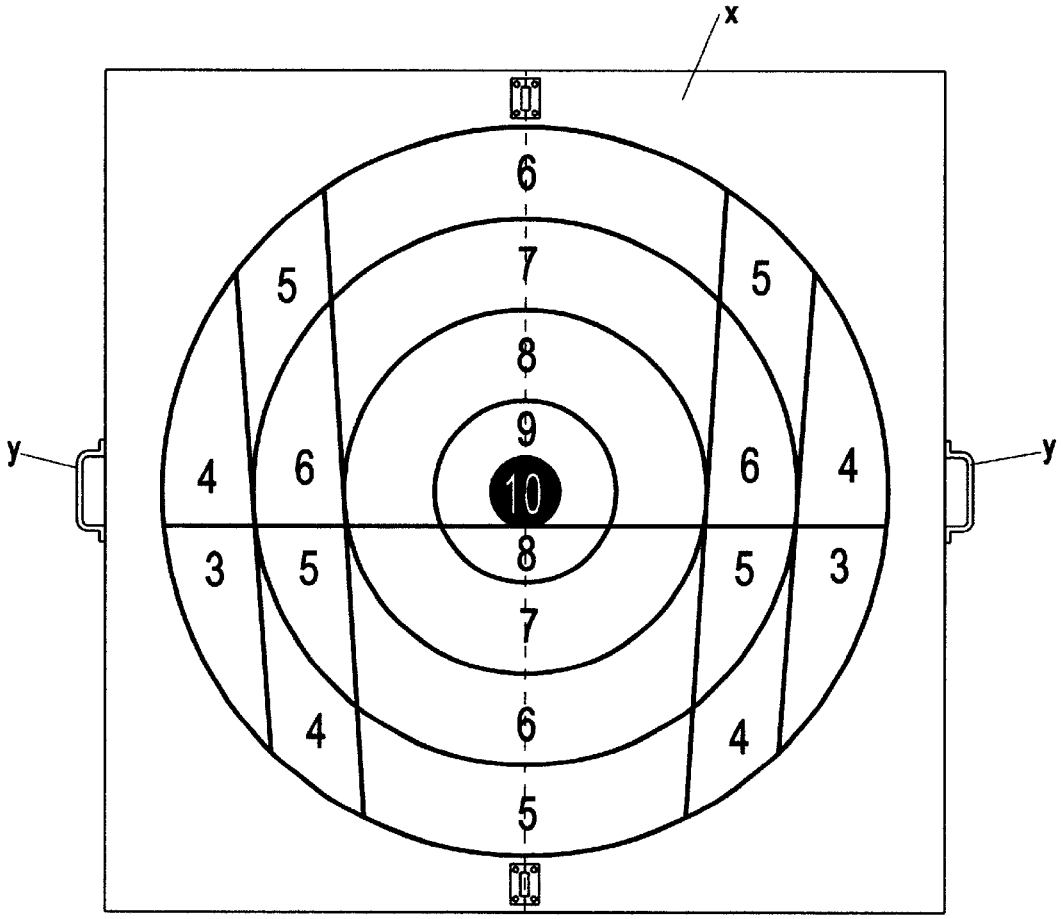
FIG. 2 is a top view of the present invention upon which a food filling has been placed, prior to any folding or rolling.

The target pattern a is provided on a portable see-through overlay x as shown in FIG. 2. Overlay x designed to be portable, since it is constantly being placed over a golf hole for scoring, and then removed again. It must be sufficiently transparent or at least translucent to allow the positions of the ball marks underneath to be seen through the overlay. It may be constructed from two or more rigid plastic sheets hingedly attached to each other using hinges z with handles y for carrying. Alternatively, the pattern of the overlay may be provided on a flexible sheet that can be rolled and unrolled, or folded and unfolded.

It is preferred that the inner circle over the hole, and the area inside the next two innermost concentric circles of the target pattern on the overlay be crossed only by the horizontal line. Then on the outside edges of the third and fourth circles, the parallel tangential lines are provided.

In alternative embodiments, one or more additional concentric circles and/or one or more additional parallel lines may be provided to create a larger target. The scoring values for these outer areas would be correspondingly lower than the inner areas of the target. Also, in alternative embodiments, the parallel lines may be made truly perpendicular to the horizontal line k.

In another alternative embodiment, the pattern of the overlay may be temporarily or permanently imprinted or painted onto the grass around each of the holes of a putting green.

It is to be understood that variations and modifications of the present invention may be made without departing from the scope thereof. It is also to be understood that the present invention is not to be limited by the specific embodiments disclosed herein, but only in accordance with the appended claims when read in light of the foregoing specification.

I claim:

1. A portable golf game apparatus for use on a natural ground surface comprising a flat transparent overlay for placement on a golf green over the golf hole, said overlay including a pattern in the form of a target having a central circle corresponding to a golf hole, a plurality of concentric circular lines surrounding said central circle defining a plurality of annular spaces between the circular lines, a horizontal line across said target tangential to said central circle, said horizontal line dividing said annular spaces into first and second sections on opposite sides of said line, said first sections having smaller areas than said second sections, and scoring values provided in said sections, said scoring values being highest in said central circle and decreasing radially outwardly, said scoring values being higher in each of said second sections than in each of said corresponding first sections.

2. The apparatus of claim 1 wherein a first pair of parallel lines is provided on said overlay in nearly perpendicular relationship to said horizontal line on one side of said pattern, each of said parallel lines being tangential to one of said concentric circular lines, and each of said parallel lines being sloped away from the central circle; and wherein a second pair of parallel lines is provided on said overlay in nearly perpendicular relationship to said horizontal line on the opposite side of said pattern, each of said second parallel lines being tangential to one of said concentric circular lines, and each of said second parallel lines also being sloped away from the central circle.

3. A pattern for a golf putting target comprising a central circle corresponding to a golf hole, a plurality of concentric circular lines surrounding said central circle defining a plurality of annular spaces between the circular lines, a horizontal line across said target tangential to said central circle, said horizontal line dividing said annular spaces into first and second sections on opposite sides of said line, said first sections having smaller areas than said second sections, and scoring values provided in said sections, said scoring values being highest in said central circle and decreasing radially outwardly, said scoring values being higher in each of said second sections than in each of said corresponding first sections.

4. The putting target of claim 3 wherein a first pair of parallel lines is provided in nearly perpendicular relationship to said horizontal line on one side of said pattern, each of said parallel lines being tangential to one of said concentric circular lines, and each of said parallel lines being sloped away from the central circle; and wherein a second pair of parallel lines is provided in nearly perpendicular relationship to said horizontal line on the opposite side of said pattern, each of said second parallel lines being tangential to one of said concentric circular lines, and each of said second parallel lines also being sloped away from the central circle.

5. A portable apparatus for teaching improved putting in golf comprising a flat transparent sheet having a pattern thereon in the form of a target which includes a central circle corresponding to a golf hole, a plurality of concentric circles surrounding said central circle defining a plurality of annular spaces, a horizontal line across said target tangential to said central circle, said horizontal line dividing said annular spaces into first and second sections on opposite sides of said line, said first sections having smaller areas than said second sections, and scoring values provided in said sections, said scoring values being highest in said central circle and decreasing radially outwardly, said scoring values being higher in each of said second sections than in each of said corresponding first sections.

6. The apparatus of claim 5 wherein said sheet is provided in the form of a set of panels hingedly attached to each other.

7. The apparatus of claim 6 wherein at least one carrying handle is provided on said sheet.

8. The apparatus of claim 5 wherein said sheet is provided in the form of durable flexible material that may be rolled up for ease of transport.

9. A method for improving golf putting comprising the steps of:

a. establishing a location for starting a putt toward a hole on a golf green;

b. executing a putt of a golf ball from said location toward said hole;

c. marking the position of the golf ball after the putt is executed;

d. removing the golf ball;

e. placing a scoring overlay over said hole for determining the score to be awarded based on said position, said overlay comprising a flat transparent sheet having a pattern thereon in the form of a target which includes a central circle corresponding to a golf hole, a plurality of concentric circles surrounding said central circle defining a plurality of annular spaces, a horizontal line across said target tangential to said central circle, said horizontal line dividing said annular spaces into first and second sections on opposite sides of said line, said first sections having smaller areas than said second sections, and scoring values provided in said sections, said scoring values being highest in said central circle and decreasing radially outwardly, said scoring values being higher in each of said second sections than in each of said corresponding first sections;

f. orienting said overlay such that said horizontal line is perpendicular to the direction of said putt; and g. recording the score based on the marked position of the ball.

10. The method of claim 9 wherein steps a–g. are repeated using a plurality of different starting locations.

* * * * *